US011148180B2

(12) United States Patent
MacNeil et al.

(10) Patent No.: US 11,148,180 B2
(45) Date of Patent: Oct. 19, 2021

(54) COKE REMOVAL IN VERTICAL RISERS

(71) Applicant: Mac & Mac Hydrodemolition Inc., Surrey (CA)

(72) Inventors: Gerard J. MacNeil, Surrey (CA); Jesse MacNeil, Surrey (CA); Brett MacNeil, Surrey (CA); Gordon MacNeil, Surrey (CA); Vernon Bose, Surrey (CA)

(73) Assignee: MAC & MAC HYDRODEMOLITION INC.

( * ) Notice: Subject to any disclaimer, the term of this patent is extended or adjusted under 35 U.S.C. 154(b) by 86 days.

(21) Appl. No.: 16/689,546

(22) Filed: Nov. 20, 2019

(65) Prior Publication Data

US 2020/0164415 A1 May 28, 2020

(30) Foreign Application Priority Data

Nov. 23, 2018 (CA) ..... 3025118

(51) Int. Cl.

| | |
|---|---|
| ***C10B 33/00*** | (2006.01) |
| ***B08B 9/043*** | (2006.01) |
| ***B08B 9/032*** | (2006.01) |
| ***B08B 3/02*** | (2006.01) |

(52) U.S. Cl.

CPC ..... *B08B 9/0433* (2013.01); *B08B 3/024* (2013.01); *B08B 9/0321* (2013.01); *C10B 33/006* (2013.01)

(58) Field of Classification Search

CPC ..... E21B 43/29; E21B 43/292; C10G 75/00–75/04; C10G 9/16; C10B 33/006; B08B 9/027–9/057; B08B 9/08; B08B 9/093; B08B 9/0936; B08B 3/02; B08B 3/024; Y10S 585/95; Y10T 29/4544; F16L 2101/10; F16L 2101/12; B05B 3/002; B05B 3/02–3/12; B05B 3/18; B05B 13/06; B05B 13/0627; B05B 13/0636

See application file for complete search history.

*Primary Examiner* — Mikhail Kornakov
*Assistant Examiner* — Richard Z. Zhang
(74) *Attorney, Agent, or Firm* — Ostrolenk Faber LLP

(57) ABSTRACT

A method of removing an obstruction of coke built up in a riser of a fluid catalytic converter and of cleaning the riser involves using a suspended centralizer and narrowly angled nozzles for first hydroblasting a drainage orifice in the obstruction, adjusting guide arms and manipulating the suspended apparatus to allow enlargement of the orifice, further adjusting the guide arms and enlarging the angles of the nozzles to work the remaining coke built up.

10 Claims, 4 Drawing Sheets

COKE REMOVAL IN VERTICAL RISERS

CROSS-REFERENCE TO A RELATED APPLICATION

The present application claims priority to Canadian Patent Application No. 3,025,118, filed Nov. 23, 2018, the contents of which are incorporated herein by reference.

FIELD OF THE INVENTION

This invention relates to the cleaning and maintenance of vertical risers in fluid catalytic converters where the riser has been nearly fully obstructed by a coke buildup.

BACKGROUND OF THE INVENTION

Vertical risers may be subject to a significant build-up of coke along the walls of the riser and about the feed nozzles, degrading the throughput of the system. It is known to introduce personnel into the riser equipped with a high-pressure hose to manually clean the walls by hydroblasting, also known as hydrodemolition.

A particular problem arises where the coke residue has built up to a point that it blocks the riser. As a result, the introduction of water from the high-pressure nozzles presents a challenge in evacuating the water from the riser. It then becomes dangerous to introduce personnel into the riser.

The walls of the riser are made of refractory. The high pressures used to remove coke build-up are typically in the range of 40,000 psi and those same pressures can also used to remove refractory. Hydroblasting the coke build-up therefore presents a risk of unintentionally damaging the refractory of the riser itself or the feed nozzles that project within the inner diameter of the riser.

It is an object of the invention to provide a means of removing the coke build-up in a riser in a fluid catalytic converter, particularly when the coke build-up has blocked or nearly blocked the riser entirely.

That and other objects will be better understood by reference to this application as a whole. Not all of the objects are necessarily met by all embodiments of the invention described below.

SUMMARY OF THE INVENTION

According to the invention there is provided a centralizer body with radially-extending guide arms for abutment against the side wall of the riser. An elongated stem extends below and centrally from the centralizer body and terminates in a plurality of angled nozzles. The apparatus is suspended from an opening at the top of the riser. High pressure water is fed through a tube extending from the opening to the nozzles.

The coke build up and any resulting obstruction tends to be more acute adjacent the feed nozzles of the riser. As the vertical distance from the feed nozzles increases, the build-up of coke along the walls of the riser typically decreases.

The stem is sufficiently long to present the nozzles close to the obstruction, while still allowing the guide arms of the centralizer to engage the walls of the riser at a point that is relatively unhindered by the build-up of coke on the inside surfaces of the wall. In a preferred embodiment, the stem is at least as long as the length of the centralizer body. The stem is preferably modular to allow a combination of stem extensions to increase the distance between the nozzles and the centralizer body. Such adjustable length accommodates different vertical extents of coke build-up between the obstruction and the centralizer body.

In a first stage, the length or angle of the guide arms are selected such that the guide arms are in contact with the inside wall of the riser. As a result, the centralizer body and the nozzles are substantially centered along the longitudinal axis of the riser. The nozzles are angled slightly off axis, for example at 10-15° from the vertical. The unit is suspended vertically from the entrance of the riser and is lowered sufficiently that the nozzles at the end of the stem are adjacent the coke obstruction. The nozzles are fed to produce water jets at 40,000 psi in a narrow angled cone well away from the walls of the riser. The objective of this first stage is to blast away a small diameter orifice in the obstruction to allow water and debris to be evacuated during subsequent hydroblasting.

During the first stage, the contact of the centralizer arms with the wall of the riser keeps the unit centered to ensure a consistent focus for the nozzles in opening a drainage orifice in the obstruction.

Once the orifice has been created, the apparatus is withdrawn from the riser and reconfigured. The guide arms of the centralizer are re-arranged such that they are spaced from contact with the wall of the riser. A lateral pulley is mounted on the cable suspending the apparatus. The angle of the nozzles and the pressure of the water feeding the nozzles are not changed. The unit is then lowered again so that the nozzles are adjacent the orifice. However, because the guide arms are no longer in abutment with the wall of the riser, it is possible for an operator to use the lateral pulley to urge the suspended apparatus and its associated hydroblasting nozzles off the longitudinal axis of the riser and to direct the nozzles to the sides of the orifice. By manipulating the pulley, the nozzles are made to enlarge the orifice by directing the narrow swath of the nozzles around the remaining obstruction.

Once the obstruction has been effectively cleared, there will remain a build-up of coke along the walls of the riser. In a final step, the apparatus is again removed from the riser and reconfigured. The guide arms are brought back into contact with the wall of the riser and the angle of the nozzles are adjusted to at most 45° to be able to reach the walls of the riser from the central longitudinal axis. At that angle, the jet from the nozzles will likely impinge the refractory of the riser, though at an angle of less than 45°. To further reduce the risk of cutting into the refractory or of damaging the riser feed nozzles, the water pressure is also lowered to a range of 35,000 psi or less. The stem may also be shortened. The unit is then lowered while operating the nozzles in order to clean out the remaining coke build-up along the walls of the riser.

Where it is determined that the optimal target area to create a drainage orifice is not along the longitudinal axis of the riser, a slightly different approach is used. The guide arms of the centralizer body are adjusted such that when the apparatus is suspended in the riser, the stem and its nozzles will be aligned with the target area. The balance of the process is substantially as described above.

In one aspect, the invention is a method of removing coke built up in a riser of a fluid catalytic converter in which the coke build up has created an obstruction substantially blocking the riser, comprising:

providing an apparatus for introduction of the apparatus into an opening at the top of the riser. The apparatus comprises a centralizer body having radially extending guide arms for contacting the inner surface of the riser wall, a stem extending downward from a center of the centralizer body, the stem having a length greater than the length of the centralizer body and a plurality of nozzles at the far end of the stem (the end that is distal from the centralizer body);

setting the nozzles at an angle of less than 15 degrees from the vertical for a narrow zone of hydroblasting;

selecting a length of stem that enables the centralizer body to be adjacent a portion of said wall that is sufficiently unhindered from coke build up to allow the centralizer body to be substantially centered by the guide arms along the longitudinal axis of the riser while the nozzles are substantially adjacent the obstruction, i.e. spanning across any intervening build up or tapering of the obstruction along the riser wall;

vertically suspending the apparatus from the riser opening to present the nozzles adjacent the obstruction;

feeding high pressure water to the nozzles and hydroblasting a narrow portion of the obstruction to bore a drainage orifice;

reconfiguring the guide arms to be spaced from abutment with the wall, leaving a gap, and mounting a lateral pulley to a cable suspending the apparatus; and, feeding high pressure water to the nozzles while operating the lateral pulley to displace the apparatus and nozzles away from the longitudinal axis of the riser to thereby hydroblast an area around the orifice to enlarge the orifice.

Preferably, the guide arms are then reconfigured to be in contact with the wall, the angle of the nozzles is enlarged and the water pressure is reduced to a lower pressure and the nozzles are operated at the lower pressure while vertically displacing the apparatus so as to remove coke build up along the riser wall.

In another aspect the invention is a method of removing coke built up in a riser of a fluid catalytic converter in which the coke build up has created an obstruction substantially blocking the riser, comprising:

providing an apparatus for introduction of the apparatus into an opening at the top of the riser. The apparatus comprises a centralizer body having radially extending guide arms for contacting the inner surface of a wall of the riser, a stem extending downward from a center of the centralizer body, the stem having a length greater than a length of the centralizer body and a plurality of nozzles at an end of the stem that is distal from the centralizer body;

selecting a length of the stem that enables the centralizer body to be adjacent a portion of the wall that has sufficiently little coke build up to allow the centralizer to be substantially centered along a longitudinal axis of the riser while the nozzles are substantially adjacent the obstruction;

vertically suspending the apparatus from the opening to present the nozzles adjacent the obstruction;

feeding high pressure water to the nozzles and hydroblasting a narrow portion of the obstruction to bore a drainage orifice through the obstruction; and, feeding high pressure water to the nozzles while displacing the apparatus and nozzles away from the longitudinal axis of the riser to thereby hydroblast an area around the orifice to enlarge the orifice.

In that alternative aspect, the method may further comprise, prior to the step of feeding high pressure water to the nozzles to hydroblast a narrow portion, setting angles of the nozzles at an angle of less than 15 degrees from the vertical and, prior to the step of feeding high pressure water to said nozzles while displacing said apparatus, reconfiguring said guide arms to be spaced from abutment with said wall and mounting a lateral pulley to a cable suspending said apparatus.

In a further aspect, the invention is a method of removing coke built up in a riser of a fluid catalytic converter in which the coke build up has created an obstruction substantially blocking the riser, comprising:

providing an apparatus for introduction of the apparatus into an opening at the top of the riser. The apparatus comprises a centralizer body having radially extending guide arms for contacting the inner surface of a wall of the riser, a stem extending downward from a center of the centralizer body, said stem having a length greater than a length of the centralizer body and a plurality of nozzles at an end of the stem that is distal from the centralizer body;

selecting a narrow target area of the obstruction for the creation of a drainage orifice;

adjusting the guide arms to align the stem with the target area when the apparatus is suspended in the riser and the guide arms are in contact with the wall of the riser;

selecting a length of the stem that enables the centralizer body to be adjacent a portion of the wall that has sufficiently little coke build up to allow the centralizer to be substantially centered along a longitudinal axis of the riser while the nozzles are substantially adjacent the obstruction;

vertically suspending the apparatus from the opening to present the nozzles in alignment with and adjacent the target area;

feeding high pressure water to the nozzles and hydroblasting a narrow portion of the obstruction to bore a drainage orifice through the obstruction;

reconfiguring the guide arms to be spaced from abutment with the wall and mounting a lateral pulley to a cable suspending the apparatus; and, feeding high pressure water to the nozzles while operating the lateral pulley to displace the apparatus and nozzles away from the longitudinal axis of the riser to thereby hydroblast an area around the orifice to enlarge the orifice.

The further aspect of the invention may also comprise reconfiguring the guide arms to be in contact with the wall, enlarging the angle of the nozzles and reducing a pressure of the water to a lower pressure and feeding the nozzles with the lower pressure while vertically displacing the apparatus so as to remove coke build up along the wall.

In yet a further aspect, the invention is a method of removing coke built up in a riser of a fluid catalytic converter in which the coke build up has created an obstruction substantially blocking the riser, comprising:

providing an apparatus for introduction of the apparatus into an opening at the top of the riser. The apparatus comprises a centralizer body having radially extending guide arms for contacting the inner surface of a wall of the riser, a stem extending downward from a center the centralizer body, the stem having a length greater than a length of the centralizer body and a plurality of nozzles at an end of the stem that is distal from the centralizer body;

setting angles of the nozzles at an angle of less than 15 degrees from the vertical;

selecting a length of the stem that enables the centralizer body to be adjacent a portion of the wall that has sufficiently little coke build up to allow the centralizer body to be substantially centered by the guide arms along a longitudinal axis of the riser while the nozzles are substantially adjacent the obstruction;

vertically suspending the apparatus from the opening to present the nozzles adjacent the obstruction;

feeding high pressure water to the nozzles and hydroblasting a narrow portion of the obstruction to bore a drainage orifice through the obstruction; and, hydroblasting the obstruction to disintegrate and clear the obstruction from the riser.

According to that yet further aspect, the last step of hydroblasting the obstruction may comprise reconfiguring the guide arms to be spaced from abutment with the wall and mounting a lateral pulley to a cable suspending the apparatus and may further include the step of feeding high pressure water to the nozzles while operating the lateral pulley to displace the apparatus and nozzles away from the longitudinal axis of the riser to thereby hydroblast an area around the orifice to enlarge the orifice.

The method may further comprise reconfiguring the guide arms to be in contact with the wall, enlarging the angle of the nozzles and reducing a pressure of the high pressure water to a lower pressure and feeding the nozzles with the lower pressure while vertically displacing the apparatus so as to remove coke build up along the wall.

The foregoing may cover only some of the aspects of the invention. Other and sometimes more particular aspects of the invention will be appreciated by reference to the following description of at least one preferred mode for carrying out the invention in terms of one or more examples. The following mode(s) for carrying out the invention are not a definition of the invention itself, but are only example(s) that embody the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF THE PREFERRED EMBODIMENT

Figure 1:
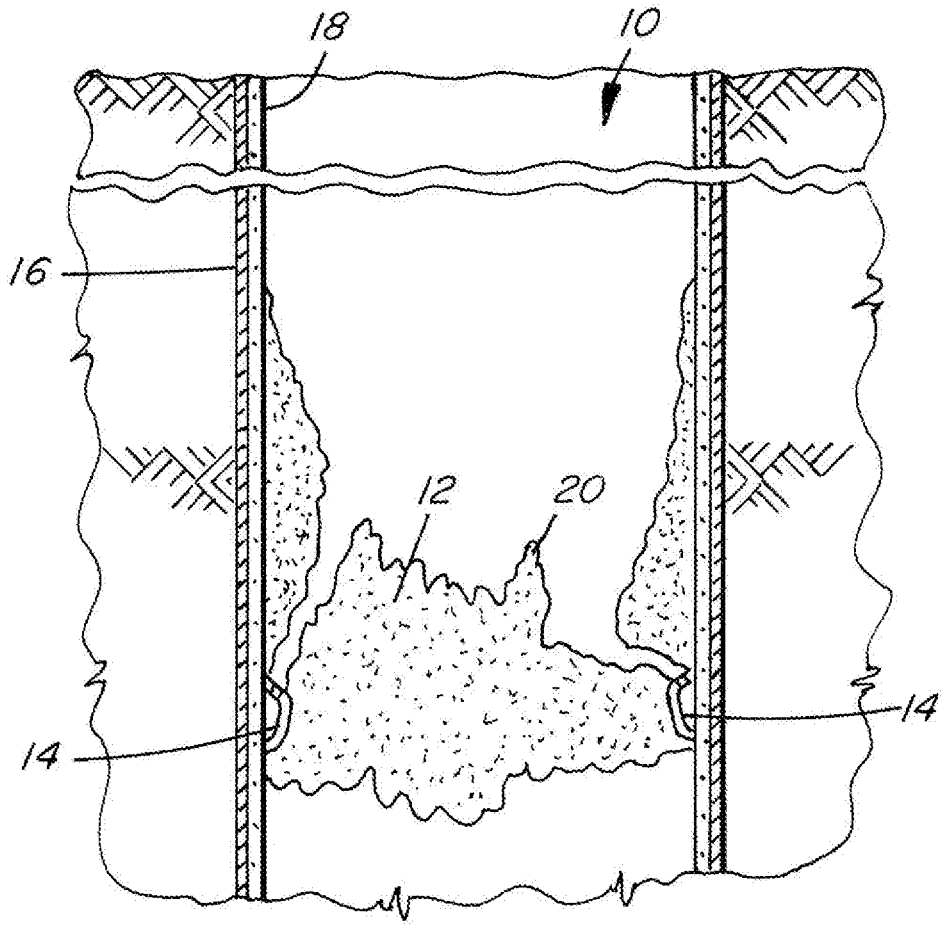
FIG. 1 is a vertical sectional view of a blocked riser.

FIG. 1 shows an example of a riser 10 in a fluid catalytic converter and including a coke build-up 12 substantially and effectively blocking or at least significantly impeding the flow through the riser. Feed nozzles 14 are located on a wall of the riser. The wall 16 of the riser comprises a refractory 18 over which the build-up 12 accumulates. As is sometimes the case, a "shark fin" 20 of build-up is illustrated in FIG. 1. The build-up 12 tapers with the vertical distance from the feed nozzles 14.

Figure 2:
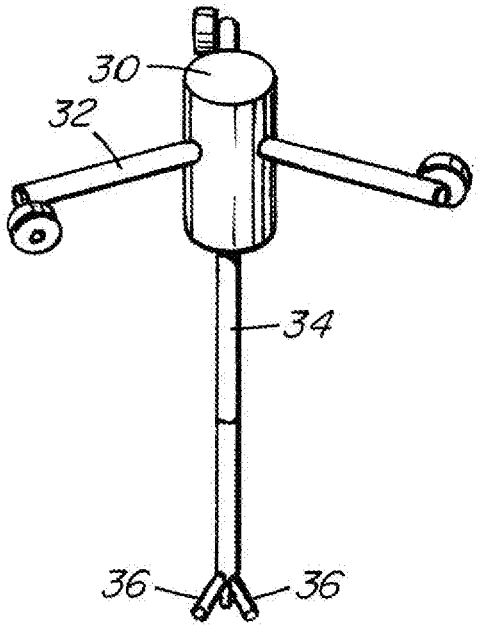
FIG. 2 is a side elevation of a hydrodemolition apparatus according to the preferred embodiment.
Figure 3:
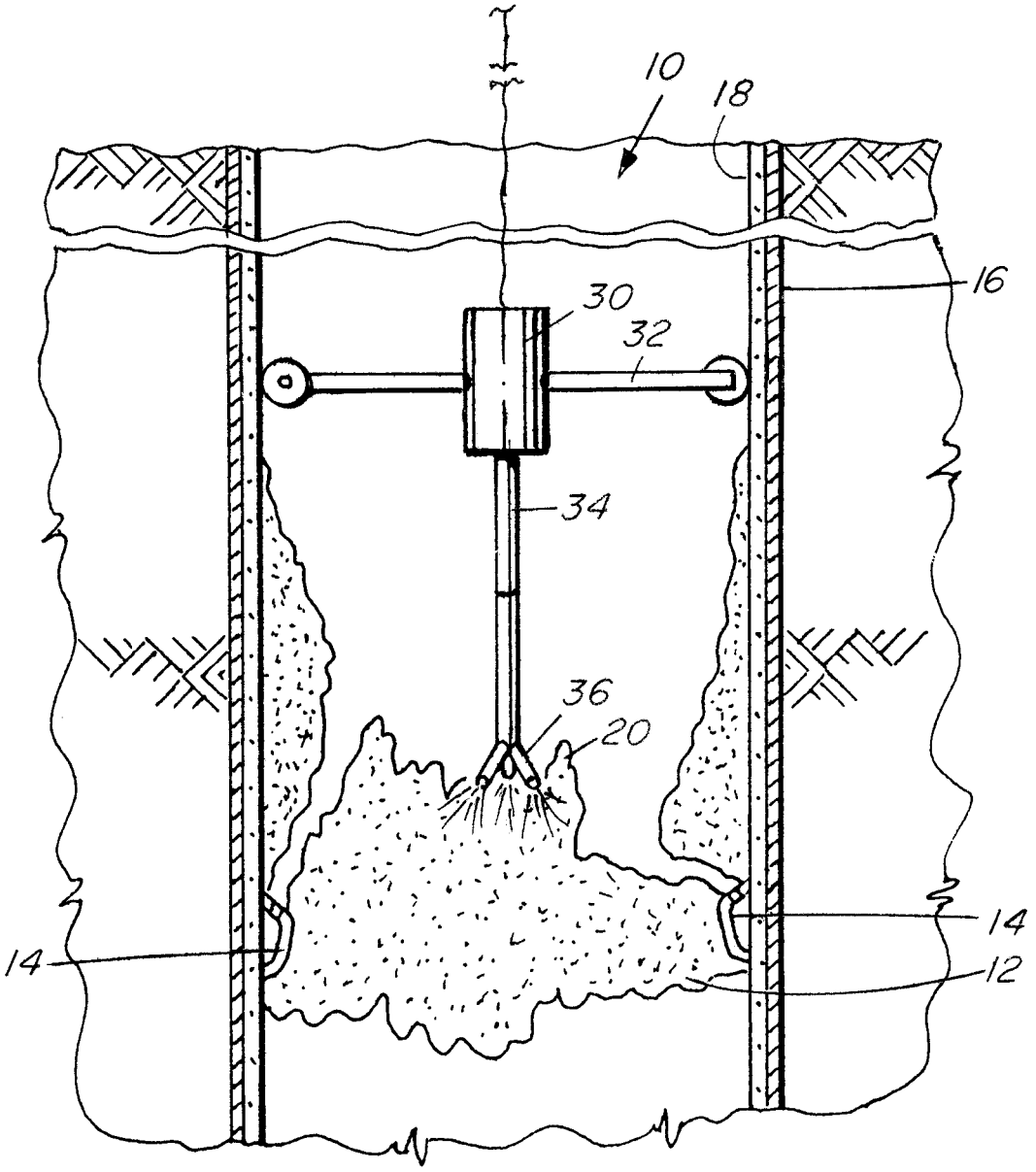
FIG. 3 is a vertical sectional view of the apparatus in operation in an initial phase of the method of the invention.

As seen in FIG. 2, the hydrodemolition apparatus 29 is provided according to the preferred embodiment, which apparatus comprises a centralizer body or frame 30, radially extending guide or centralizer arms 32 for abutting contact with the wall 16 of the riser 10, an elongated stem 34 extending downward and centrally from the centralizer body and terminating in a plurality of angled nozzles 36. The nozzles 36 are at an end of the stem 34 that is distal from the centralizer body 30. Water is fed to the apparatus, preferably by means of a hose 38 or alternatively through the stem. In use in the riser, the apparatus 29 is vertically suspended from a cable 40 mounted to a winch (see FIG. 4).

In order to accommodate the method aspect of the invention, the guide arms 32 may have varying lengths or may easily be removed and replaced with arms of different lengths. According to the preferred embodiment, the arms 32 are extendible by telescoping. Alternatively the arms 32 may be adjustable in the angle they present to the centralizer body 30 thereby effectively varying the radial extension of the arms.

The elongated stem 34 may also be configured for varying lengths. According to the preferred embodiment, one or more hollow modular stem segments 31, 33 may be attached to one another to extend the overall stem length according to the configuration of the build-up 12 in the riser. Preferably the stem 34 is at least as long and may be longer than the length of the centralizer body 30. In use, the length of the stem 34 is selected to enable the centralizer body 30 to be adjacent a portion of the wall that has sufficiently little coke build up to allow the centralizer body to be substantially centered by the guide arms along the longitudinal axis of the riser while the nozzles are substantially adjacent the obstruction.

According to a method of the invention, the radial extent of the centralizer arms 32 are first arranged such that they are in contact with the wall 16 of the riser 10. The points of contact of the arms 32 with the wall 16 of the riser are preferably vertically spaced from any significant build-up 12 on the wall of the riser, i.e. the centralizer body may be made to operate in contact with a portion of the riser wall that is substantially unhindered by coke build up. Contact between the arms 32 and the wall 16 effectively center the centralizer body or frame 30 along the longitudinal (vertical) axis of the riser 10.

The nozzles 36 are angled slight off axis, less than 15° from the vertical and preferably from 10-15° from the vertical. The apparatus 29 is suspended vertically from the entrance at the top of the riser 10 and is lowered sufficiently that the nozzles at the end of the stem are adjacent (near) the coke obstruction. Prior to the insertion of the apparatus into the riser, the length of the stem is determined by the distance between the lowest most accessible portion of the build-up 12 on the one hand and the lowest portion of the wall 16 that is sufficiently unobstructed by build-up so as to allow effective centering of the apparatus 29 by means of the arms 32 bearing against the wall 16.

The nozzles 36 are fed with high pressure water (preferably approximately 40,000 psi) to produce water jets in a narrow angled cone to effectively bore into the build up at the lowest most accessible point of the build-up. That point coincides with the likely shortest vertical extent of build-up. The objective of this first stage is to blast away a relatively small diameter drainage orifice in the obstruction to allow water and debris to be evacuated during subsequent hydroblasting. During this phase of the operation, the contact between the centralizer arms 32 and the wall 12 of the riser keeps the unit 29 centered to ensure a consistent focus for the nozzles in opening an orifice in the obstruction.

Figure 4:
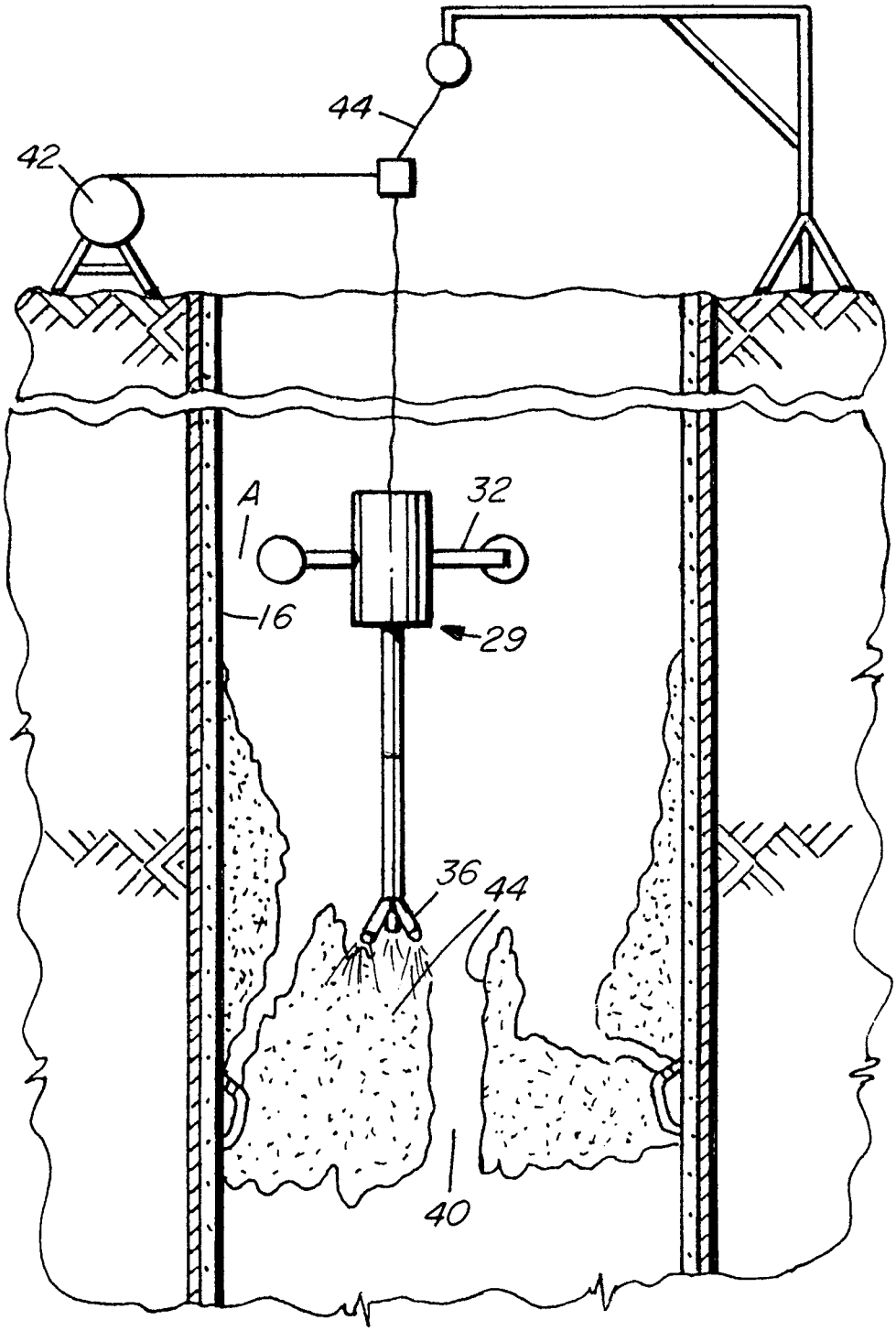
FIG. 4 is a vertical section view of a configuration for a subsequent phase of the method of the invention; and, FIG. 5 is a vertical section view of the apparatus in operation in a final phase of the method of the invention.

Once the orifice 40 (see FIG. 4) has been created, the apparatus 29 is withdrawn from the riser and reconfigured as illustrated in FIG. 4. The guide arms 32 are re-arranged such that they are spaced ("A") from contact with the wall 16 of the riser, leaving gaps between the arms 32 and the riser wall. A lateral pulley 42 is mounted on the cable 44 suspending the apparatus 29. The angle of the nozzles 36 and the pressure of the water feeding the nozzles need not be changed for this next step.

The unit 29 is then lowered again so that the nozzles 36 are adjacent the orifice 40. However, because the guide arms 32 are no longer in abutment with the wall 16 of the riser, it is possible for an operator to use the lateral pulley 42 to urge the suspended apparatus 29 and its associated nozzles 36 off the longitudinal axis of the riser and to direct the nozzles to the sides 44 of the orifice 40. By manipulating the pulley, the nozzles 36 are made to enlarge the orifice 40 by directing the narrow swath of the nozzles around the remaining obstruction.

Figure 5:
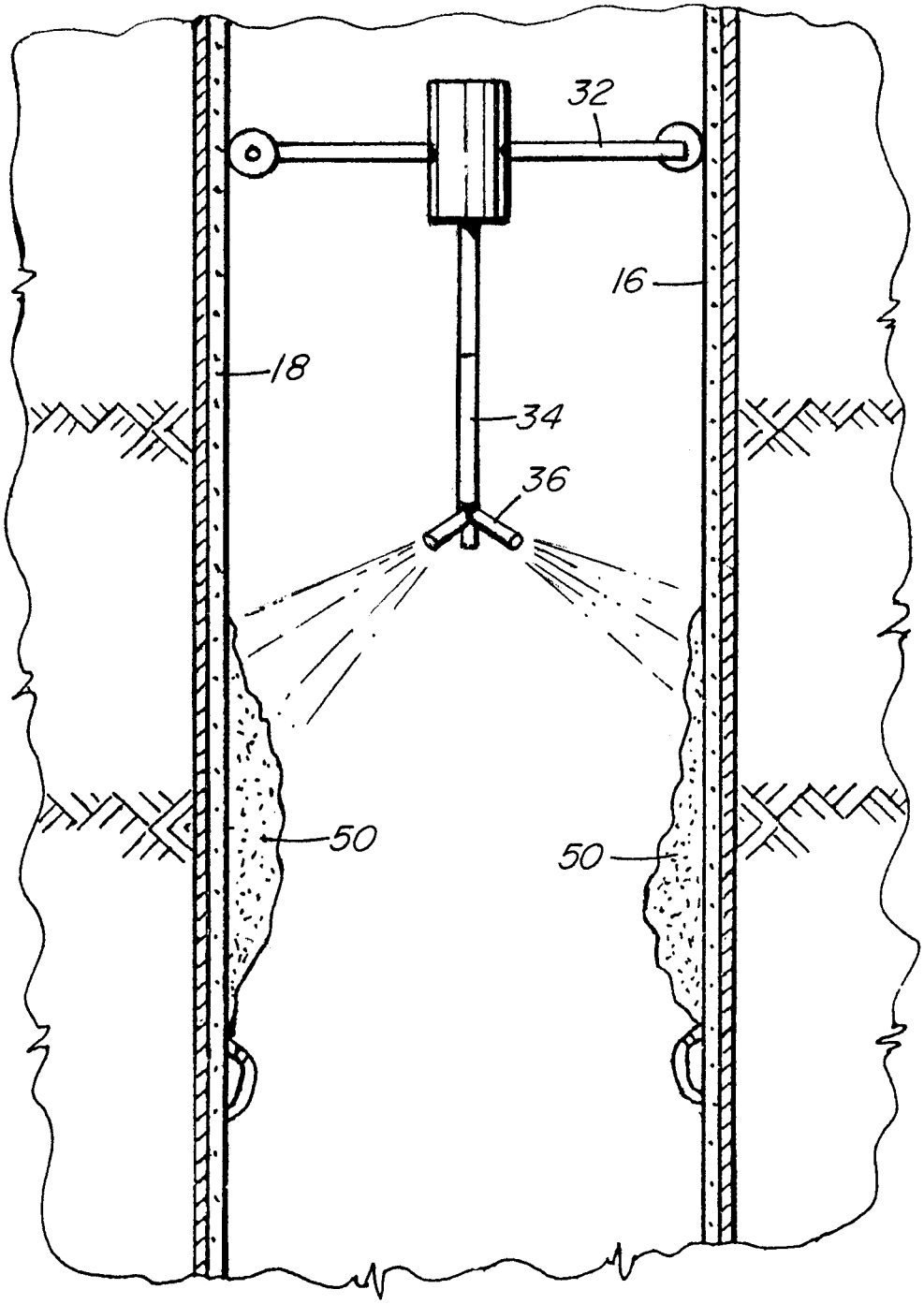

Once the obstruction has been effectively cleared, there will remain a build-up (50 in FIG. 5) along the wall of the riser. In a final step, the apparatus 29 is again removed from the riser and reconfigured. The guide arms 32 are brought back into contact with the wall 16 of the riser and the angle of the nozzles 36 are adjusted to at most 45° to be able to reach the walls of the riser from the central longitudinal axis. At that angle, the jet from the nozzles will likely impinge the refractory 18 of the riser, though at an angle of less than 45° to minimize the risk of destroying the refractory 18. To further reduce the risk of cutting into the refractory or of damaging the riser feed nozzles, the water pressure is also reduced to a lower pressure in the range of 35,000 psi or less. The stem 34 may also be shortened. The unit is then lowered vertically while operating the nozzles in order to clean out the remaining coke build-up along the walls of the riser.

The shape of the coke obstruction in the riser may not necessarily present itself such that the easiest area in which bore a drainage orifice is along the central longitudinal axis of the riser. In such case, a narrow target area for boring a drainage orifice is selected. The guide arms 32 are adjusted so that the stem is aligned with the selected target area when the centralizer body 30 is suspended in the riser with the guide arms in contact with the riser wall 16. The drainage orifice is created by hydroblasting the narrow target area while the apparatus is suspended in the riser. The subsequent steps are as described above.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A method of removing coke built up in a riser of a fluid catalytic converter in which the coke build up has created an obstruction substantially blocking the riser, comprising:

providing an apparatus for introduction of said apparatus into an opening at the top of said riser, said apparatus comprising:

a centralizer body having radially extending guide arms for contacting an inner surface of a wall of said riser;

a stem extending downward from a center of said centralizer body, said stem having a length greater than a length of said centralizer body;

a plurality of nozzles at an end of said stem that is distal from said centralizer body;

setting a respective angle of each of said nozzles at less than 15 degrees from the stem;

adjusting the length of said stem so that the centralizer body is adjacent to a portion of said wall that has sufficiently little coke build, thereby allowing the centralizer body to be substantially centered by said guide arms along a longitudinal axis of the riser while said nozzles are substantially adjacent to said obstruction;

vertically suspending said apparatus from said opening to present said nozzles adjacent to said obstruction;

feeding high pressure water to said nozzles and hydroblasting a narrow portion of said obstruction to bore a drainage orifice through said obstruction;

reconfiguring said guide arms to be spaced from abutment with said wall and mounting a lateral pulley to a cable vertically suspending said apparatus; and, feeding high pressure water to said nozzles while operating said lateral pulley to displace said apparatus and said nozzles away from the longitudinal axis of said riser to thereby hydroblast an area around said drainage orifice to enlarge said drainage orifice.

2. The method of claim 1 further comprising:

reconfiguring said guide arms to be in contact with said wall, enlarging the respective angle of each of said nozzles and reducing a pressure of said high pressure water to provide a lower pressure water; and, feeding said nozzles with said lower pressure water while vertically displacing said apparatus so as to remove coke build up along said wall.

3. The method of claim 1 wherein said apparatus comprises a stem that may wherein said stem may be adjusted to varying lengths by telescoping said stem or by adding or removing modular lengths of said stem.

4. A method of removing coke built up in a riser of a fluid catalytic converter in which the coke build up has created an obstruction substantially blocking the riser, comprising:

providing an apparatus for introduction of said apparatus into an opening at the top of said riser, said apparatus comprising:

a centralizer body having radially extending guide arms for contacting an inner surface of a wall of said riser;

a stem extending downward from a center of said centralizer body, said stem having a length greater than a length of said centralizer body;

a plurality of nozzles at an end of said stem that is distal from said centralizer body;

adjusting the length of said stem so that the centralizer body is adjacent to a portion of said wall that has sufficiently little coke build up, thereby allowing the centralizer body to be substantially centered along a longitudinal axis of the riser while said nozzles are substantially adjacent to said obstruction;

vertically suspending said apparatus from said opening to present said nozzles adjacent to said obstruction;

feeding high pressure water to said nozzles and hydroblasting a narrow portion of said obstruction to bore a drainage orifice through said obstruction; and, feeding high pressure water to said nozzles while displacing said apparatus and said nozzles away from the longitudinal axis of said riser to thereby hydroblast an area around said drainage orifice to enlarge said drainage orifice.

5. The method of claim 4 further comprising:

prior to the step of feeding high pressure water to said nozzles and hydroblasting said narrow portion of said obstruction, setting a respective angle of each of said nozzles at less than 15 degrees from the stem; and, prior to the step of feeding high pressure water to said nozzles while displacing said apparatus and said nozzles, reconfiguring said guide arms to be spaced from abutment with said wall and mounting a lateral pulley to a cable vertically suspending said apparatus.

6. A method of removing coke built up in a riser of a fluid catalytic converter in which the coke build up has created an obstruction substantially blocking the riser, comprising:

providing an apparatus for introduction of said apparatus into an opening at the top of said riser, said apparatus comprising:

a centralizer body having radially extending guide arms for contacting an inner surface of a wall of said riser;

a stem extending downward from a center of said centralizer body, said stem having a length greater than a length of said centralizer body;

a plurality of nozzles at an end of said stem that is distal from said centralizer body;

selecting a narrow target area of said obstruction for the creation of a drainage orifice;

adjusting said guide arms to align said stem with said target area when said apparatus is suspended in said riser and said guide arms are in contact with the wall of said riser;

adjusting the length of said stem so that the centralizer body is adjacent to a portion of said wall that has sufficiently little coke build up, thereby allowing the centralizer body to be substantially centered along a longitudinal axis of the riser while said nozzles are substantially adjacent to said obstruction;

vertically suspending said apparatus from said opening to present said nozzles in alignment with and adjacent to said target area;

feeding high pressure water to said nozzles and hydroblasting a narrow portion of said obstruction to bore a drainage orifice through said obstruction;

reconfiguring said guide arms to be spaced from abutment with said wall and mounting a lateral pulley to a cable vertically suspending said apparatus; and, feeding high pressure water to said nozzles while operating said lateral pulley to displace said apparatus and said nozzles away from the longitudinal axis of said riser to thereby hydroblast an area around said drainage orifice to enlarge said drainage orifice.

7. The method of claim 6 further comprising:

reconfiguring said guide arms to be in contact with said wall, enlarging the respective angle of each of said nozzles and reducing a pressure of said high pressure water to provide a lower pressure water; and, feeding said nozzles with said lower pressure water while vertically displacing said apparatus so as to remove coke build up along said wall.

8. A method of removing coke built up in a riser of a fluid catalytic converter in which the coke build up has created an obstruction substantially blocking the riser, comprising:

providing an apparatus for introduction of said apparatus into an opening at the top of said riser, said apparatus comprising:

a centralizer body having radially extending guide arms for contacting an inner surface of a wall of said riser;

a stem extending downward from a center of said centralizer body, said stem having a length greater than a length of said centralizer body;

a plurality of nozzles at an end of said stem that is distal from said centralizer body;

setting a respective angle of each of said nozzles at less than 15 degrees from the stem;

adjusting the length of said stem so that the centralizer body is adjacent to a portion of said wall that has sufficiently little coke build up, thereby allowing the centralizer body to be substantially centered by said guide arms along a longitudinal axis of the riser while said nozzles are substantially adjacent to said obstruction;

vertically suspending said apparatus from said opening to present said nozzles adjacent to said obstruction;

feeding high pressure water to said nozzles and hydroblasting a narrow portion of said obstruction to bore a drainage orifice through said obstruction; and, hydroblasting said obstruction to disintegrate and clear said obstruction from said riser; and wherein said step of hydroblasting said obstruction comprises:

reconfiguring said guide arms to be spaced from abutment with said wall and mounting a lateral pulley to a cable vertically suspending said apparatus; and, feeding high pressure water to said nozzles while operating said lateral pulley to displace said apparatus and said nozzles away from the longitudinal axis of said riser to thereby hydroblast an area around said drainage orifice to enlarge said drainage orifice.

9. The method of claim 8 further comprising:

reconfiguring said guide arms to be in contact with said wall, enlarging the respective angle of each of said nozzles and reducing a pressure of said high pressure water to provide a lower pressure water; and, feeding said nozzles with said lower pressure water while vertically displacing said apparatus so as to remove coke build up along said wall.

10. The method of any of claim 2, 7 or 9 further comprising shortening said stem prior to said step of feeding said nozzles with said lower pressure water.

* * * * *